US005638615A

United States Patent [19]

Korsen

[11] Patent Number: 5,638,615

[45] Date of Patent: Jun. 17, 1997

[54] SHOE SPIKE APPARATUS

[76] Inventor: David L. Korsen, 1203 Lawndale Dr., Twin Falls, Id. 83301

[21] Appl. No.: 548,610

[22] Filed: Oct. 26, 1995

Related U.S. Application Data

[63] Continuation-in-part of Ser. No. 249,270, May 25, 1994, Pat. No. 5,475,937.

[51] Int. Cl.[6] ..... A43C 15/02

[52] U.S. Cl. ..... 36/134; 36/67 D

[58] Field of Search ..... 36/134, 67 D, 36/36 B, 36 C, 59 A, 36 R, 42, 15

[56] References Cited

U.S. PATENT DOCUMENTS

| | | | |
|---|---|---|---|
| 1,278,320 | 9/1918 | Ellithorpe | 36/59 A |
| 1,344,972 | 6/1920 | Armour | 36/59 A |
| 1,366,518 | 1/1921 | Buchman . | |
| 1,601,700 | 9/1926 | Morrison | 36/59 A |
| 1,797,668 | 3/1931 | Morisse | 36/134 X |
| 2,288,168 | 6/1942 | Leu | 36/36 R |
| 2,478,810 | 8/1949 | Deschenes et al. | 36/36 B |
| 2,607,134 | 8/1952 | Langer | 36/59 |
| 2,608,007 | 8/1952 | Shapiro | 36/2.5 |
| 2,734,288 | 2/1956 | Phillips et al. | 36/36 B |
| 2,745,197 | 5/1956 | Holt | 36/134 X |
| 3,351,967 | 11/1967 | Dardig | 12/147 |
| 3,403,461 | 10/1968 | McCarney | 36/67 |
| 3,559,308 | 2/1971 | Bernier et al. | 36/134 |
| 3,566,489 | 3/1971 | Morley | 36/67 |
| 4,035,934 | 7/1977 | Hrivnak | 36/67 D |
| 4,240,215 | 12/1980 | Broussard | 36/67 D |
| 4,262,434 | 4/1981 | Michelotti | 36/67 D |
| 4,318,232 | 3/1982 | Ching | 36/73 |
| 4,380,878 | 4/1983 | Skaja | 36/67 D |
| 4,414,763 | 11/1983 | Bente | 36/134 |
| 4,445,288 | 5/1984 | Frör | 36/134 |
| 4,492,047 | 1/1985 | Arff | 36/134 |
| 4,633,600 | 1/1987 | Dassler et al. | 36/134 |
| 4,644,672 | 2/1987 | Dassler et al. | 36/134 |
| 4,648,187 | 3/1987 | Dassler et al. | 36/134 |
| 4,698,923 | 10/1987 | Arff | 36/128 |
| 4,706,394 | 11/1987 | Regula | 36/67 D |
| 4,875,300 | 10/1989 | Kazz | 36/134 |
| 5,027,532 | 7/1991 | MacNeill et al. | 36/134 |
| 5,123,184 | 6/1992 | Ferreira | 36/134 |
| 5,259,129 | 11/1993 | Deacon et al. | 36/127 |
| 5,475,937 | 12/1995 | Korsen | 36/67 D X |

FOREIGN PATENT DOCUMENTS

| | | |
|---|---|---|
| 10591 | 3/1934 | Australia . |
| 61715 | 10/1982 | European Pat. Off. . |
| 320029 | 10/1929 | France . |
| 2260084 | 12/1972 | Germany . |
| 216399 | 8/1941 | Switzerland . |
| 209315 | 1/1924 | United Kingdom . |
| 401847 | 11/1933 | United Kingdom . |

*Primary Examiner*—Ted Kavanaugh
*Attorney, Agent, or Firm*—Laubscher & Laubscher

[57] ABSTRACT

Shoe spike apparatus permitting quick interchange or replacement of gripping elements, said apparatus including a shoe sole attachment plate with a downwardly depending stabilizer shaft, a plurality of spring fingers affixed to the plate, and a spike member having a base provided with a recess for receiving the stabilizer shaft and an exterior geometric configuration on the base which mates with the spring fingers so as to retain the spike member firmly and without lateral movement to the attachment plate and shaft. Circular construction of engaging surfaces of the spike member and the socket and spring fingers allows rotational movement of the spike member relative to the socket to prevent rotational stress which might otherwise tear the sole attachment plate from the sole in which it is embedded. Rigid contact surfaces permit only unidirectional removal of the spike member from the socket for ensuring the integrity of the snap lock mechanism.

9 Claims, 2 Drawing Sheets

FIG.1
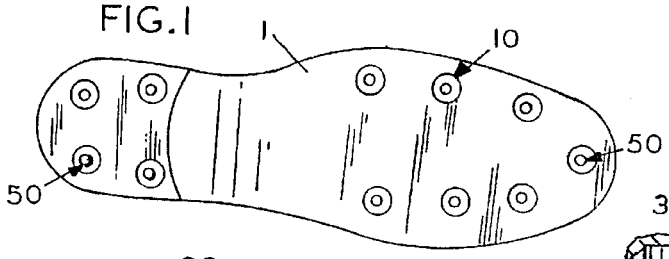
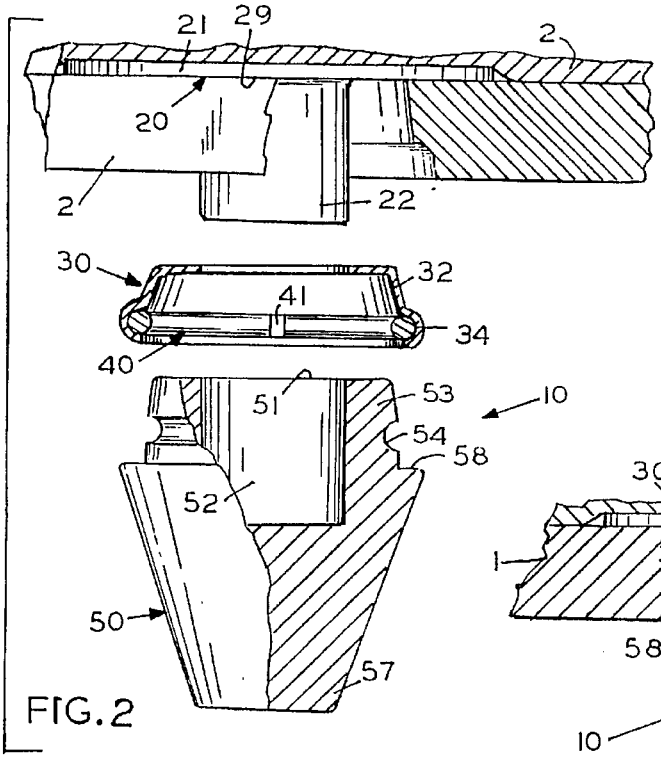
FIG.2
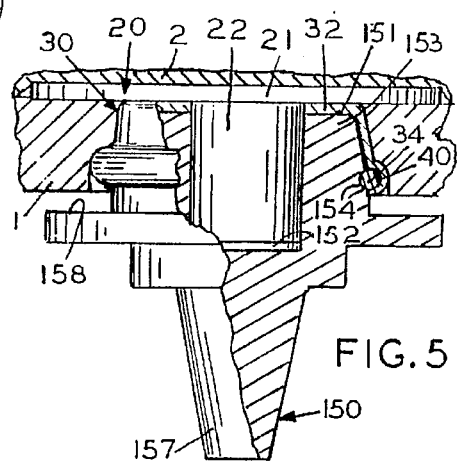
FIG.5
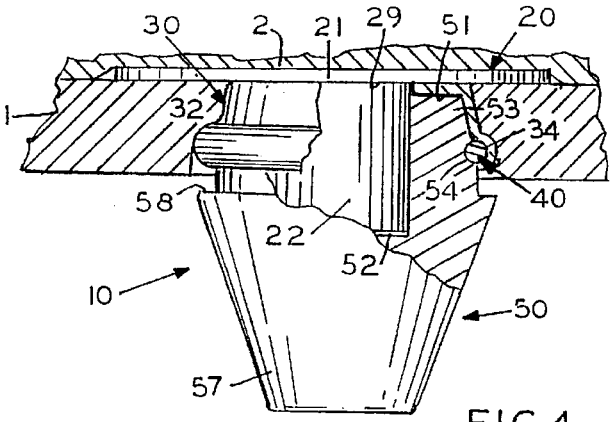
FIG.4
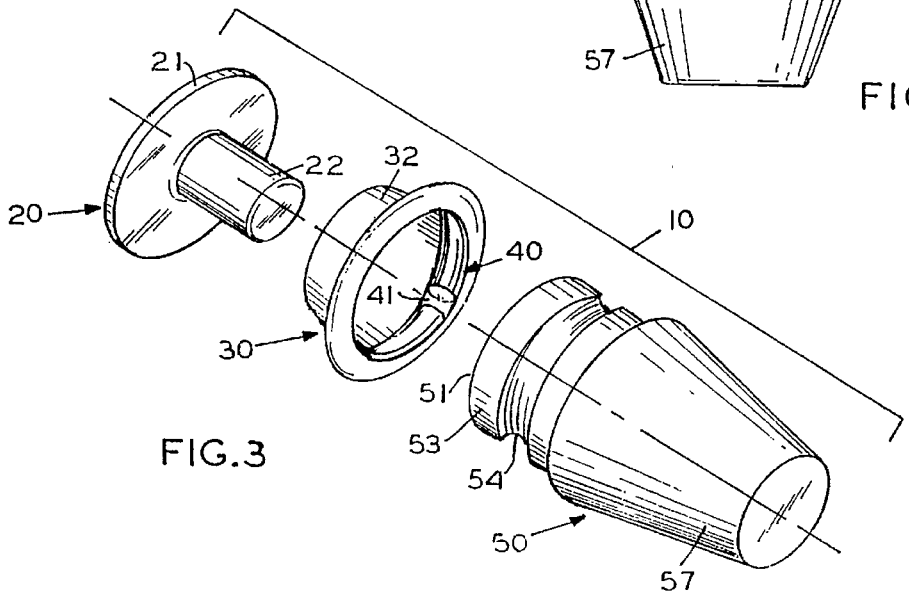
FIG.3

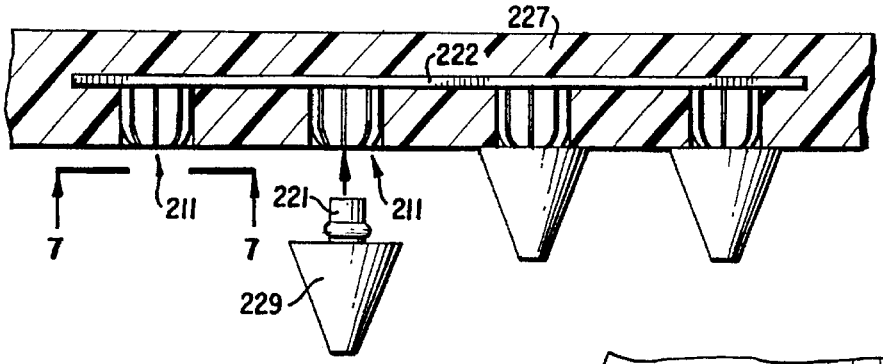
FIG. 6
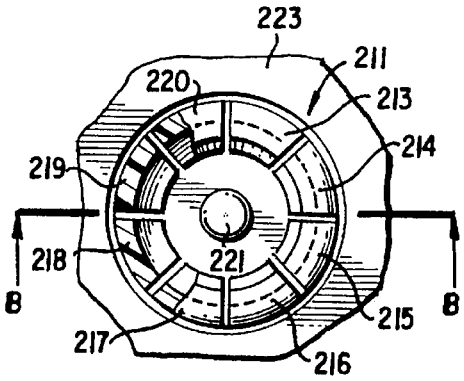
FIG. 7
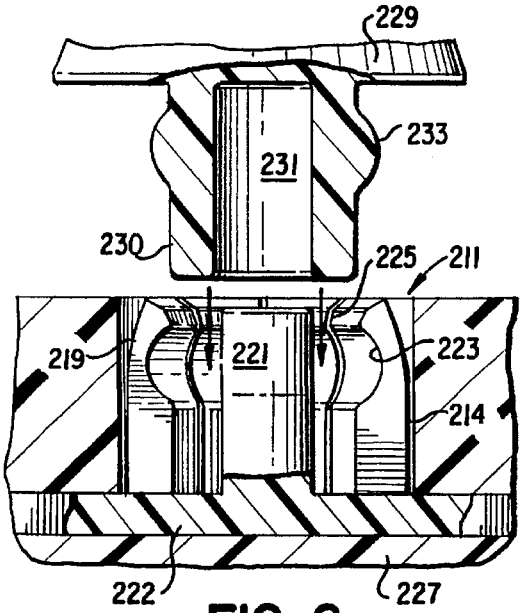
FIG. 8
FIG. 9
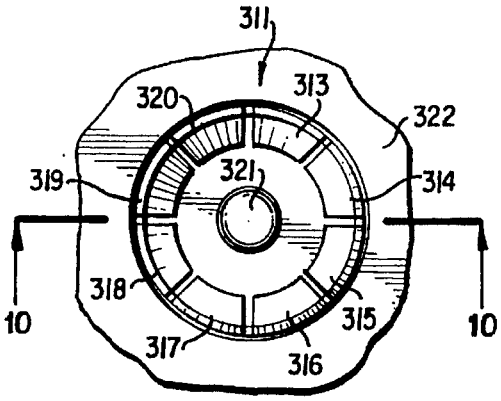
FIG. 10
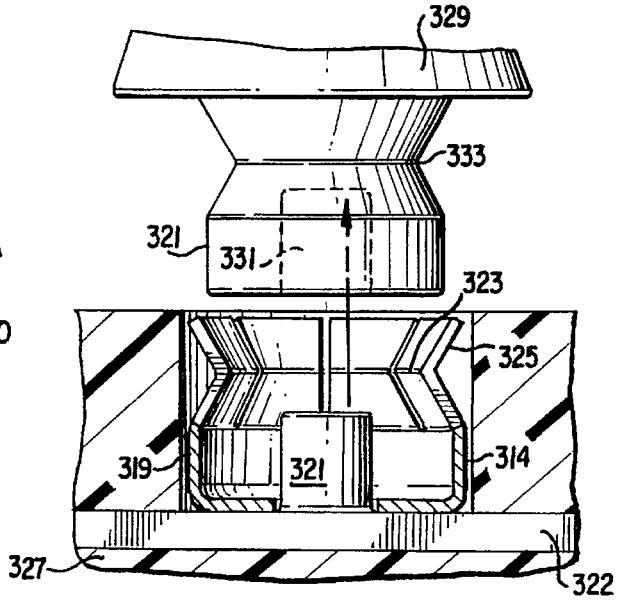

SHOE SPIKE APPARATUS

This is a continuation-in-part of U.S. application Ser. No. 08/249,270 filed May 25, 1994, now U.S. Pat. No. 5,475,937 entitled SHOE SPIKE APPARATUS.

FIELD OF THE INVENTION

This invention relates to spike apparatus for shoes and, more particularly, to interchangeable and readily removable and replaceable spikes/cleats for athletic shoes.

DESCRIPTION OF THE PRIOR ART

It is to be understood that use of the term "spikes" in the following description includes all types of gripping elements which may be used on shoes.

The desirability of cleats and spikes on shoes for superior traction has long been recognized, particularly in the athletic endeavors of runners, golfers, football players, soccer players, and the like. It is also highly desirable that individual spikes be readily removable and replaceable where the spike has become broken, deformed, or otherwise impaired and where other gripping elements are desired.

Typifying the present art in an attempt to provide such spikes or cleats are the two patents of Dassler et al, U.S. Pat. Nos. 4,633,600 and 4,644,672, as well as the patent of A. Hrivnak, U.S. Pat. No. 4,035,934. Dassler utilizes an elastic annular rib in a snap-lock arrangement and a screw-on type element to hold the gripping members to a shoe stud. The Hrivnak device utilizes a pair of spring members having shoulders which lock into a flange on the spike member to hold the spike in place.

Problems in the prior art include the loss of spikes which are screwed into place or constructed of elastic material; damage to the supporting sole where rotational stress is placed upon a non-rotatable spike; complicated and expensive spike retention members; time required to inter-change spikes; and lateral movement of the spike members within sockets of studs, also causing loss or damage.

SUMMARY OF THE INVENTION

The shoe spike apparatus of the present invention overcomes the problems of the prior art in providing shoe attachment means provided with a spring retainer and a stabilizer shaft perpendicularly depending from the attachment means and a spike member having a section for mating with the spring retainer for locking the spike member to the socket. The circular rigid shaft is received within a mating opening in the spike member to prevent any lateral movement between the spike member and the socket and yet permit rotational movement of the spike member within the socket to eliminate rotational stress on the attachment means engagement with the sole of the shoe. Such construction allows removal of the spike member from the socket only in a unidirectional manner to ensure the locking integrity of the snap ring. All engagement members, other than the spring retainer, are inflexible for precision fit. Additional objects and advantages will become apparent and a more thorough and comprehensive understanding may be had from the following description taken in conjunction with the accompanying drawings forming a part of this specification.

BRIEF DESCRIPTION OF THE DRAWINGS

FIG. 1 is a plan view of a shoe sole showing the shoe spike members of the present invention installed;

FIG. 2 is an exploded side view, in partial section, of the present invention as attachable to a shoe sole;

FIG. 3 is a perspective exploded view of the device of the present invention, in partial section;

FIG. 4 is a side view with all structural elements in place for use;

FIG. 5 is a side view of a second embodiment of the present invention;

FIG. 6 is a partial cross-sectional view of a plurality of spike members in place in and removed from a shoe sole;

FIG. 7 is a partial top view partly in section taken along the lines 7—7 of FIG. 6;

FIG. 8 is an enlarged cross-sectional view taken through lines 8—8 of FIG. 7 and includes an exploded view of the associated spike member;

FIG. 9 is a partial top view of a further modification of the spike member retainer of the present invention; and FIG. 10 is an enlarged cross-sectional view taken through lines 10—10 of FIG. 9 and includes an exploded view of the associated spike member.

DETAILED DESCRIPTION OF THE INVENTION

Referring now to the drawings, FIGS. 1–4, a first embodiment to be preferred of shoe spike apparatus 10, made according to the present invention, is disclosed. Shoe spike apparatus 10 includes, generally, shoe attachment means 20, snap ring socket 30, snap ring 40, and spike member 50.

Shoe attachment means 20 includes anchor plate 21 made of rigid material, preferably of metal such as stainless steel. The anchor plate includes planar opposing surfaces and may be circular in form, as shown in FIG. 3. The anchor plate is embedded in outer sole 1 of the shoe or between the outer sole and show base 2. Plate 21 is provided with a downwardly depending stabilizer shaft 22, also constructed of rigid material such as stainless steel. Shaft 22 is perpendicularly affixed to plate 21 by means such as welding, screws, or by other conventional fasteners, or may be integral with the plate. The shaft may be either hollow or solid, solid being preferred, and is circular in cross section for reasons hereinafter stated.

Also affixed to the anchor plate by means such as welding or otherwise is rigid snap ring socket 30, also constructed of metal. Socket 30 is tubular in shape, having a cylindrical wall 32 which is coaxially spaced relative to stabilizer shaft 22. Wall 32 defines on its inner surface an annular groove 34 for receiving ring 40. Snap ring 40 is constructed of flexible steel, circular in cross section, and defines an expansion-contraction gap 41, as is conventional with snap rings.

Spike member 50 is provided with base portion 53 and gripping portion 57. The base portion may be integral with the gripping portion or the gripping portion may be constructed of a different material than the base portion, depending upon the gripping characteristics required. Where construction is of a material differing in composition from the base portion, the gripping portion may be affixed to the base portion by any suitable means. It is essential to the invention that the base portion be constructed of a rigid material, stainless steel being preferred, because of its engagement with both snap ring 40 and stabilizer shaft 22.

Base portion 53 is circular in cross section and contains on its exterior surface annular groove 54 for receiving snap ring 40 contained within groove 34 of socket 30 to snap-lock spike member 50 to the socket and, hence, shoe attachment means 20. The base portion also defines a recess or opening 52, perpendicular to a planar end surface 51, for snug reception of and engagement with shaft 22 of shoe attachment means 20. It is to be noted and appreciated that this circular construction allows complete and free rotation of spike member 50 within socket 30 to eliminate tearing of the anchor plate from the sole, which often results where rotation of the spike member is not possible. Planar end surface 51 of the spike member presents a surface for flush engagement with surface 29 of plate 21, cooperating in the rotational movement of the spike member.

Gripping portion 57 of spike member 50 may be of any suitable material and of any suitable length and shape, such dimensions being dependent upon designed use. The gripping portion is provided with tool engagement means for removal of spike member 50 from socket 30 and from shaft 22 of shoe attachment means 20. In the embodiment shown, the tool engagement means comprises shoulder 58 extending about the peripheral base of the gripping portion of the spike. Any edged tool of suitable dimensions or a coin may be used to dislocate spike member 50 from the socket and snap ring. It is obvious that other tool engagement means may be provided, such as recesses, clamping areas, etc.

Referring now to FIG. 5, a second embodiment of the present invention may be seen. Like numbers refer to the same structural elements as in the first embodiment. The primary difference in the second embodiment is spike member 150, which is provided with base portion 153 and gripping portion 157. As in the first embodiment, the base portion is provided with an annular groove 154 for receiving snap ring 40 and a recess 152 for receiving shaft 22 of shoe attachment means 20. Unlike the first embodiment, spike member 150 includes an expansive shoulder in the nature of apron 158, serving to cover and act as a shield to protect underlying snap ring socket 30 from entry of soil, grass, or other debris.

Again referring to the first embodiment, for installation of spike member 50 into socket 30, the spike member is simply inserted into socket 30 with opening 52 of the spike member receiving shaft 22 of shoe attachment means 20. A slight pressure on spike gripping portion 57 causes the spike member to move into socket 30, with groove 54 of the spike member snapping into locking engagement with snap ring 40, held in groove 34 of socket 30. It will be noted that lateral movement is precluded between the spike member and the socket and that the only directional forces operable to remove the spike member are in a direction opposite to that of installation, i.e., downward movement, perpendicular to anchor plate 21. It will also be noted, then, that the natural position of the shoe and weight of the user at all times tend to keep the shoe spike in place.

For removal of a spike member from socket 30, a coin, screw driver, or other edged tool is inserted between shoulder 58 of spike member 50 and the bottom surface of socket 30. The spike member is then pried from its engagement with the snap ring and socket.

Turning now to FIGS. 6, 7, and 8, there is shown a further embodiment of the present invention. FIG. 6 shows the sole 227 of a shoe in which anchor plate 222 is embedded. A plurality of sockets 211 are Shown which contain the stabilizing shaft and spring retainer. One spike 229 and associated shaft 221 are shown in an exploded view with spike 229 above socket 211 ready for insertion therein.

FIG. 7 is a top view taken through lines 7—7 of FIG. 6 illustrating stabilizer shaft 221 with spring retainer 211 secured about shaft 221.. In this embodiment, spring retainer 211 includes spring fingers 213, 214, 215, 216, 217, 218, 219, and 220. While a specific number of spring fingers are shown in this embodiment and in the next embodiment, it is to be understood that the invention is not limited to any particular number of such spring fingers.

The details of the components of FIGS. 6 and 7 are more clearly shown in the cross-sectional view of FIG. 8. The spring fingers, here shown as 214 and 219, extend upwardly from anchor plate 222, as does stabilizer shaft 221. Each of the spring fingers are identical and, accordingly, the detailed description will be limited to one of such spring fingers. Spring finger 214 is shown as including concave section 223 located substantially in the mid-section of the finger. Above concave section 223, spring finger 214 terminates in bevel 225 for purposes which will become apparent from the following description.

In this embodiment, base 230 includes circular borehole 231, which is geometrically configured so as to mate with stabilizer shaft 221 when the two parts are joined. The circumferential convex fingers are integral with stabilizer shaft 221 and extend outwardly therefrom. Convex ring 233 on base 230 is of a geometrical configuration such that it mates with concave section 223 of the spring members when the two parts are mated. In order to assist entry of stabilizer shaft 221 into socket 211, fingers 214 include bevel 225.

As will be evident, this embodiment provides the required stability wherein base 230 can be removed from its position about stabilizer shaft 221 only in a vertical, or 90° , direction. The spring fingers, when mated with circular ring 233, retain the base within the socket so as to prevent removal without an exerted force in a vertical direction. Horizontal movement of base 230 is prevented by stabilizer shaft 221. At the same time, base 230 is rotatable about stabilizer shaft 221 in the same fashion as discussed in the previous embodiments.

While the spring fingers shown in FIGS. 6–8 could be separately secured to a ANCHOR plate, the ANCHOR plate, stabilizer SHAFT, and spring fingers shown in this particular embodiment are a of a single unitary construction and may be molded from suitable plastics such as Delrin®, available from E. I. du Pont de Nemours & Company, or die cast or milled from a suitable metal which has the necessary flex.

Referring to FIGS. 9 and 10, a still further embodiment of the present invention is disclosed. The basic configuration of this embodiment is similar to that shown in FIGS. 6–8, wherein stabilizer shaft 321 extends upwardly from anchor plate 311 and is surrounded by spring fingers 313, 314, 315, 316, 317, 318, 319, and 320. In this embodiment, the spring fingers are secured to the anchor plate by any known means such as welding, adhesive, etc.

As more clearly shown in FIG. 10, all of the spring fingers extend upwardly and are identical. As shown, spring finger 314 has a reduced circumferential section 323 so as to create a flair at the open end of the spring. Base 321 includes circular borehole 331 and it further includes reduced circumferential section 333 which extends below spike 329. Reduced section 333 is geometrically configured so as to mate with section 323 of the spring fingers. Thus, base 321 is held in place by the springs in the same fashion as discussed above and can be removed only by a vertical, or 90° , force applied to the spike member. The upper section 325 of spring 314 serves as a guide and bevel surface when base 321 is set in place.

The specific length of the stabilizer shaft and corresponding depth of the mating borehole are not critical so long as the desired stabilizing function is provided. It is preferable to terminate the borehole below the spike so that excessive wear of the spike will not expose the borehole.

Having thus described in detail preferred embodiments of the present invention, it is to be appreciated and will be apparent to those skilled in the art that many physical changes could be made in the apparatus without altering the inventive concepts and principles embodied therein. The present embodiments, therefore, are to be considered in all respects as illustrative and not restrictive, the scope of the invention being indicated by the appended claims rather than by the foregoing description, and all changes which come within the meaning and range of equivalency of the claims, therefore, are to be embraced therein.

I claim:

1. Shoe spike apparatus comprising shoe attachments adapted to be secured to the base of a shoe;

a downwardly depending stabilizer shaft secured to said shoe attachment means, said stabilizer shaft being substantially circular in cross-section;

a plurality of spring fingers affixed to said shoe attachment means extending about said stabilizer shaft, each of said spring fingers having a concave section; and a spike member having a base portion and a gripping portion for gripping engagement with a foot support surface, said base portion defining a substantially circular opening for receiving said stabilizer shaft and further defining a convex section about the outer periphery of said base portion, said convex section being geometrically conformed so as to mate with said concave sections of said spring fingers, said base portion being rotatable about said stabilizer shaft when mated therewith.

2. The apparatus as described in claim 1 wherein said shoe attachments comprise an anchor plate adapted to be affixed to the sole of a shoe and wherein said stabilizer shaft and spring fingers are affixed substantially perpendicular to said anchor plate.

3. The apparatus of claim 2 wherein said anchor plate, said spring fingers, and said stabilizer shaft comprise a single unitary structure.

4. The apparatus of claim 3 wherein said unitary structure is of a molded plastic.

5. The apparatus of claim 3 wherein said unitary structure is metal.

6. The apparatus of claim 1 wherein a distal end of said spring members are beveled outwardly.

7. Shoe spike apparatus comprising shoe attachment means adapted to be secured to the base of a shoe;

a downwardly depending stabilizer shaft secured to said shoe attachment means, said stabilizer shaft being substantially circular in cross-section;

a plurality of spring fingers affixed to said shoe attachment means and extending about said stabilizer shaft so as to form a circumferential ring, each of said spring fingers having a substantially central section extending in the direction of said stabilizer shaft; and a spike member having a base portion and a gripping portion for gripping engagement with a foot support surface, said base portion defining a substantially circular opening for receiving said stabilizer shaft and further defining a reduced substantially central section having a geometrical configuration such that it mates with said central sections of said spring fingers, said base portion being rotatable about said stabilizer shaft when mated therewith.

8. The apparatus as described in claim 1 wherein said shoe attachments comprise an anchor plate adapted to be affixed to the sole of a shoe and wherein said stabilizer shaft and said spring fingers are affixed substantially perpendicular to said anchor plate.

9. The apparatus of claim 1 wherein said spring fingers are beveled outwardly at their distal ends.

* * * * *